United States Patent [19]

Hendricks

[11] Patent Number: 4,913,807

[45] Date of Patent: Apr. 3, 1990

[54] PARTICLE SEPARATOR

[75] Inventor: Charles D. Hendricks, Livermore, Calif.

[73] Assignee: The United States of America as represented by the United States Department of Energy, Washington, D.C.

[21] Appl. No.: 262,632

[22] Filed: Oct. 26, 1988

[51] Int. Cl.[4] ..... B03B 4/00; B07B 4/00

[52] U.S. Cl. ..... 209/461; 209/141; 209/158; 209/443; 209/446; 209/471; 209/474; 209/487

[58] Field of Search ..... 209/39, 40, 138, 139.1, 209/140, 141, 143, 158, 160, 161, 209, 210, 458, 459, 449, 466, 454, 443, 446, 438, 461, 462, 471, 474, 477, 479, 496, 487; 222/195

[56] References Cited

U.S. PATENT DOCUMENTS

| | | | |
|---|---|---|---|
| 698,293 | 4/1902 | Kimball | 209/158 |
| 934,441 | 9/1909 | Hitchcock | 209/161 |
| 1,948,140 | 2/1934 | Strohl | 209/158 |
| 2,683,685 | 7/1954 | Matheson | 209/141 |
| 3,102,092 | 8/1963 | Heath et al. | 209/140 |
| 3,121,593 | 2/1964 | McIlraine | 222/195 X |
| 3,269,189 | 8/1966 | Monk | 209/139.1 X |
| 3,869,903 | 3/1975 | Beach et al. | 209/160 X |
| 4,102,780 | 7/1978 | Sun et al. | 209/39 |

FOREIGN PATENT DOCUMENTS

| | | | |
|---|---|---|---|
| 0244705 | 4/1987 | German Democratic Rep. | 209/140 |
| 310696 | 9/1971 | U.S.S.R. | 209/138 |

*Primary Examiner*—Donald T. Hajec
*Attorney, Agent, or Firm*—Gary C. Roth; L. E. Carnahan; William R. Moser

[57] ABSTRACT

Method and apparatus (10) are provided for separating and classifying particles (48,50,56) by dispersing the particles within a fluid (52) that is upwardly flowing within a cone-shaped pipe (12) that has its large end (20) above its small end (18). Particles of similar size and shape (48,50) migrate to individual levels (A,B) within the flowing fluid. As the fluid is deflected by a plate (42) at the top end of the pipe (12), the smallest particles are collected on a shelf-like flange (40). Ever larger particles are collected as the flow rate of the fluid is increased. To prevent particle sticking on the walls (14) of the pipe (12), additional fluid is caused to flow into the pipe (12) through holes (68) that are specifically provided for that purpose. Sticking is further prevented by high frequency vibrators (70) that are positioned on the apparatus (10).

3 Claims, 1 Drawing Sheet

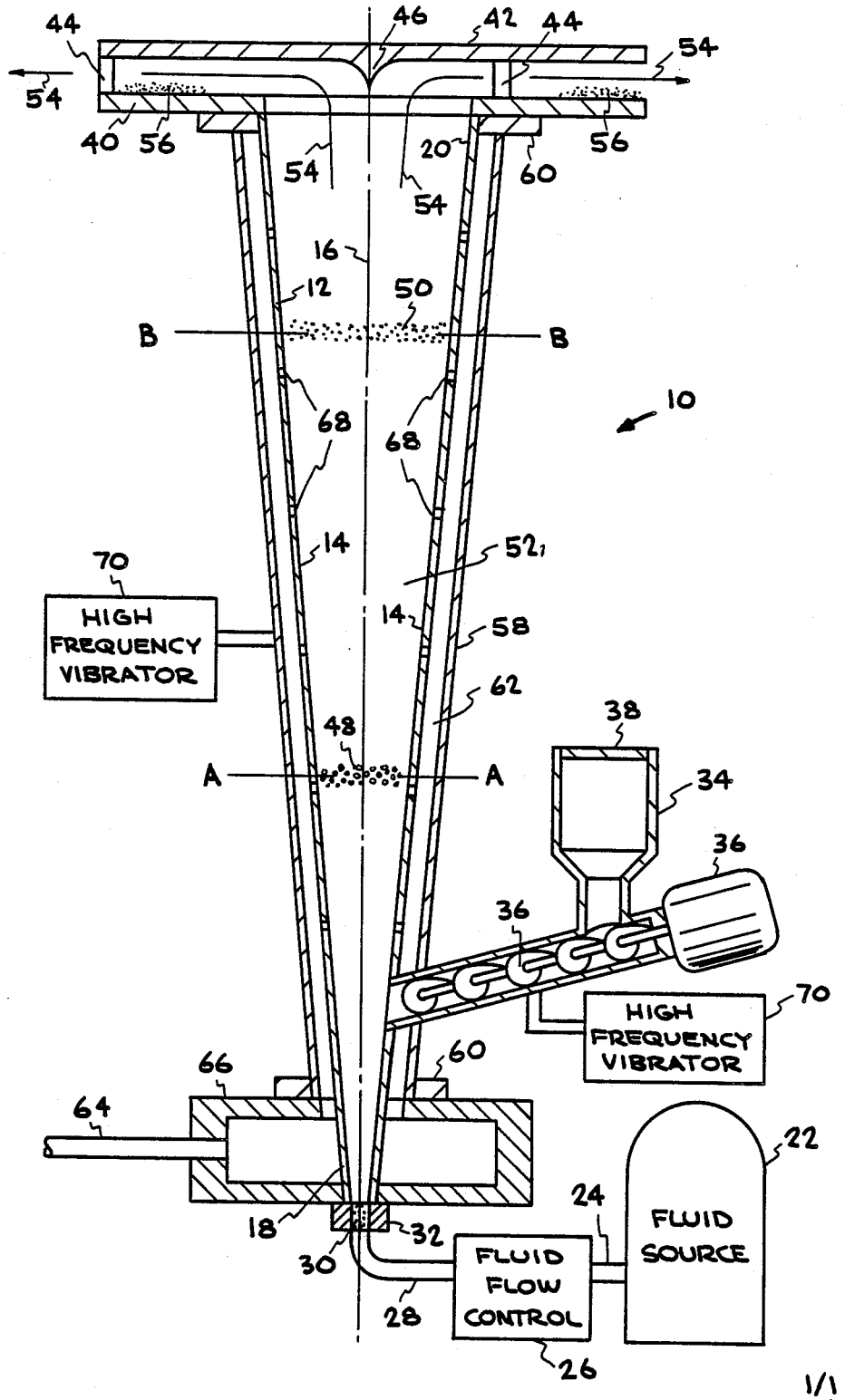
1/1

PARTICLE SEPARATOR

The U.S. Government has rights in this invention pursuant to Contract No. W-7405-ENG-48 between the U.S. Department of Energy and the University of California for the operation of the Lawrence Livermore National Laboratory.

BACKGROUND OF THE INVENTION

The invention described herein relates generally to particle separation and classification, and more particularly to methods and apparatus for separating or classifying ensembles of particles of assorted size into their various size fractions.

There are a number of known methods whereby particle classification is presently accomplished. In one such method particulate material is allowed to fall, under the influence of gravity, through a generally horizontal air flow, with the differential displacement of the material in the air flow direction, which is functional of particle mass, size and shape, being the factor determinative of classification. In another known method cyclone separators, wherein centrifugal force is generated by the tangential introduction of a high-velocity fluid stream into a conically cylindrical chamber, are used to remove liquid drops or solid particles from gases.

However, if one is confronted with the task of classifying into size fractions, tens or hundreds of grams of a typical powder, made up of often irregularly shaped particles ranging in size from tenths to hundreds of microns in diameter, one immediately perceives that the presently known methods of particle separation and classification are slow, tedious, inefficient and generally inadequate.

SUMMARY OF THE INVENTION

It is, therefore, an object of the invention to provide methods and apparatus for use in particle separation and classification.

Another object of the invention is to provide accurate, rapid and efficient methods and apparatus for separating and classifying ensembles of particles of diverse size and shape into their various size fractions.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the method of this invention comprises dispersing an ensemble of particles of diverse size and shape within a fluid undergoing an upward steady laminar flow, characterized by the fluid having an approximately common upward velocity at locations having an approximately common vertical height. The upward velocity of the fluid should monotonically decrease in magnitude at increasingly higher locations within the fluid. Particles of similar size and shape migrate to layers, or regions of approximately common vertical height, within the fluid, where their terminal velocity, with respect to the fluid, is approximately equal to the upward velocity of the fluid.

Following the migration of the particles of similar size and shape to regions of common height, it is preferable to deflect the flowing fluid horizontally, usually at a relatively high level, so that all the particles that are within the fluid and at or above the level of deflection begin to undergo a vertical descent. The particles within the deflected fluid are collected, thereby becoming separated and classified from the ensemble of which they previously constituted a part.

It is then frequently preferable to increase the volumetric flow rate of the fluid, so that the upward velocity of the flowing fluid is everywhere increased and the particle distribution within the flowing fluid rises to higher elevations, thereby permitting a second portion of particles of similar size and shape to be separated, classified, and collected from the ensemble by the deflection process described above.

Preferably the volumetric flow rate of the fluid is then further sequentially and repeatedly increased, following particle collection, until essentially all the particles of the ensemble have been separated and classified.

Very often it is preferable that the flowing fluid used in the methods and apparatus of this invention is a fluid selected from the group consisting of air, argon, carbon dioxide, helium, gaseous nitrogen, liquid nitrogen, glycerol, hexane, petroleum oil and silicone oil.

The apparatus for carrying out the methodology of this invention preferably comprises an axially-symmetric cone-shaped hollow pipe with smooth internal walls. Means are provided for introducing a steady laminar flow of fluid into the small diameter end of the pipe. Means are further provided for inserting the particles to be separated and classified into the pipe and dispersing them within the flowing fluid. An axially-symmetric and shelf-like flange is attached to the large diameter end of the pipe. The flange extends perpendicularly outward from the axis of the pipe, and provides a shelf for particle collection. Spaced apart from the large diameter end of the pipe, an axially-symmetric deflection plate is mounted perpendicularly to and across the axis of the pipe. In use, the apparatus must be oriented with the large diameter end of the pipe upward, and with the axis of the pipe perpendicular to the surface, or horizon, of the earth. Fluid introduced into the pipe and laminarly flowing steadily upward will have an approximately common upward velocity at locations of the same height. The upward fluid velocity will monotonically decrease in magnitude with increasing height within the pipe. Thus, all particles of similar size and shape will migrate to common levels within the flowing fluid where their terminal velocity, relative to the fluid, is matched by the upward velocity of the flowing fluid. When the flowing fluid passes through the large diameter end of the pipe, and is horizontally deflected by the deflection plate, particles entrained within the deflected fluid will descend and be collected on the shelf-like flange.

It is most usually preferable that the means for introducing the fluid into the pipe be adapted to function at a variable rate of volumetric flow. This permits particles of increasingly larger size and shape to be separated and collected by the apparatus.

To prevent particle sticking on the smooth internal walls of the cone-shaped pipe, where fluid velocity is zero, it is often preferable to perforate the walls of the pipe with holes that are approximately 1 to 50 microns in diameter and spaced apart from one another by a distance of approximately 5 to 200 microns. In this situation, an outer housing is attached to the pipe, but is spaced apart from its external walls, to thus provide an enclosed space between the housing and the outer walls of the pipe. A second quantity of the same type of fluid that is flowed through the center of the pipe is intromitted, or introduced, into the enclosed space, at a pressure that causes the fluid to stream inwardly through the holes and to the internal wall surface of the pipe. This relatively slight stream of fluid prevents particles from sticking on the inner walls of the cone-shaped pipe.

In some situations, to prevent particles from agglomerating within the apparatus, it is preferable to attach high frequency vibrators, as required and at various positions, upon the apparatus.

Additionally, it is at times preferable that the means for introducing the steady laminar flow of fluid into the small diameter end of the cone-shaped pipe, comprise or include passing the fluid through a sintered diffusing material.

It is thus apparent that this invention provides methods and apparatus for particle separation and classification that are efficient, rapid and accurate.

BRIEF DESCRIPTION OF THE DRAWING

The accompanying drawing, which is incorporated into and forms a part of the specification, illustrates the preferred embodiment of the invention and, together with the description, serves to explain the principles of the invention. In the drawing:

The FIGURE is a cross-sectional side view of apparatus for separating and classifying particles of diverse size and shape, made in accordance with the invention.

DETAILED DESCRIPTION OF THE INVENTION

Reference is now made in detail to the presently preferred embodiment of the invention, an example of which is illustrated in the FIGURE. An apparatus 10, for separating and classifying particles of diverse size and shape, is depicted in a cross-sectional side view. Apparatus 10 comprises a cone-shaped hollow pipe 12, having a smooth internal wall 14, that is symmetric about an axis 16. Pipe 12 has a small diameter end 18 and a large diameter end 20. Pipes of other shapes, not shown, having smoothly increasing cross sections, can function in the performance of this invention; however, the cone-shape as shown is presently preferred. A fluid source 22, a first pipe 24, a fluid volumetric flow rate controller 26, and a second pipe 28, provide means for introducing a steady laminar flow of fluid into the small diameter end 18 of pipe 12. Items 22, 24, 26 and 28, all schematically indicated, are very well known in the engineering arts and are readily available from many commercial sources. As an optional item, a plug of sintered diffusing material 30, held in a collar 32, is intended to provide a well distributed fluid flow into pipe 12, and is shown at end 18 of pipe 12. Sintered diffusing materials are defined herein as structures of porous character through which fluids may pass. They are commercially fabricated by bringing particles of various substances, such as glasses, ceramics, or metals, for example, into proximate contact, and then heating the particles, or otherwise causing them to adhere, by very well known techniques, into structurally manageable materials. Sintered diffusing materials are commonly supplied by many commercial sources such as, for example, the Corning Company of Corning, N.Y. This invention is not limited by type or kind of fluid. However, fluids comprised of a fluid selected from the group consisting of air, argon, carbon dioxide, helium, gaseous nitrogen, liquid nitrogen, glycerol, hexane, petroleum oil and silicone oil are particularly efficacious in carrying out this invention, especially for use in separating and classifying powders of small particulate size.

In use, apparatus 10 must be oriented with the large diameter end 20 of cone-shaped pipe 12 upward, and with axis 16 perpendicular to the horizon, or surface plane of the earth. In this orientation, fluid undergoing an upward steady laminar flow within cone-shaped pipe 12 will have an approximately common upward velocity at locations having an approximately common vertical height, with the upward fluid velocity monotonically decreasing in magnitude at increasingly higher locations. The theory and practical aspects of the motion of fluids, such as gasses and liquids, are well known and are described in many standard textbooks. Among these, special reference is made to "Fundamentals of Hydro-and Aeromechanics" and "Applied Hydro-and Aeromechanics", both by L. Prandtl and 0. G. Tietjens and both published by Doner Publications, Inc., and to "Fluid Mechanics", by L. D. Landau and E. M. Lifshitz, which is published by Pergamon Press. These three well known and respected textbooks are incorporated by reference herein. In practical situations, the velocity of flow along any pipe of smoothly variable cross section is determined by the equation of continuity, which simply expresses the conservation of mass. Since any fluid, and particularly any gas, used in this invention may be treated as incompressible, as is well known, the velocity of flow of fluid along cone-shaped pipe 12, at any location, is simply inversely proportional to the cross sectional area of pipe 12 at that location. When a viscous fluid undergoes steady laminar flow in a pipe of constant circular cross section, the velocity distribution across the pipe, at a sufficiently large distance from the entrance of the pipe, eventually becomes parabolic, with the velocity being zero at the surface of the pipe. In the situation of the instant invention, however, where fluid is immediately introduced into pipe 12, and pipe 12 further is not of a constant but rather of an increasing cross section, the action of fluid viscosity on flow is confined to a very thin layer, called the Prandtl boundary layer, which is immediately adjacent to the walls 14 of pipe 12. In this very thin layer, velocity steeply increases from zero to the constant value that is maintained uniformly across the pipe. Consequently, as asserted above, the upward velocity of fluid in pipe 12 both monotonically decreases in magnitude with height and is approximately constant within level strata.

Particles of diverse size and shape, not shown, may be placed in a hopper 34, and from thence inserted into pipe 12 via a rotating screw injector 36, of well known design. Hopper 32 is provided with a top 38, that prevents fluid from flowing backward through screw injector 36. Injector 36 is intended to disperse particles within fluid provided by fluid source 22.

A shelf-like flange 40, symmetric with respect to axis 16, is attached to the large diameter end 20 of cone-shaped pipe 12. Flange 40 is shown to extend outward from axis 16. A deflection plate 42, symmetric with respect to axis 16, is oriented perpendicularly to and across axis 16, and is mounted on brackets 44 in a spaced apart relationship to large diameter end 20 of pipe 12.

To facilitate its fluid deflection characteristics, plate 42 is provided with a pointed extension 46.

In operation, particles of similar size and shape within pipe 12, such as a quantity of relatively large particles 48 and a quantity of relatively small particles 50, separate and migrate, within a fluid 52 flowing in pipe 12, to individual regions of approximately the same vertical height or level. For example, larger particles 48 are shown to have migrated to a level A, and smaller particles 50 are shown to have migrated to a higher level B. This phenomenon of separation and classification is caused by each particle, within pipe 12, tending to migrate to the level where its terminal velocity, with respect to the fluid 52, is just matched, or balanced, by the upward velocity of the flowing fluid 52. It is well known that when any body or particle steadily translates through any fluid, the ratio of the inertia forces on the fluid to the viscous forces on the body, is of the order of the Reynolds number. Consequently, in situations where the Reynolds number is appreciably less than unity, as is the case in the operation of the present invention, inertial forces may be neglected, with the viscous forces providing a retarding or drag force on the particle that is exactly balanced by the gravity and buoyancy forces on the particle, such that the particle falls at what is called the terminal velocity, which is the constant free-fall velocity of the particle, under gravity and through the fluid. The analytical calculation of the terminal velocity of various bodies in general is most usually intractable; however, it has been calculated for the rigid sphere, yielding the well known result that is known as Stokes' Law; and, it has been calculated for ellipsoids of any shape, as described in the textbook "Hydrodynamics" by Sir Horace Lamb, published by Dover Publications, which is incorporated by reference herein. Fortunately for the present invention, it is not necessary to calculate terminal velocities, only to know that they exist and to make use of them. Thus, as fluid 52 flows upward through cone-shaped pipe 12 its velocity is higher at the bottom and lower at the top. A particle injected near the bottom of pipe 12 will move upward with fluid 52 until it reaches a level at which the fluid velocity decreases to its terminal velocity. The particle will then move neither up nor down, because if it moved up it would be in a position at which the fluid flow velocity would be too low to sustain it against the gravitational force, and if it moved down the fluid flow velocity would overcome the gravitational force and raise the particle. So, each particle will assume a vertical position that is commensurate with its diameter, mass, shape and the flow velocity of fluid 52 at that position. In general, larger particles, such as particles 48, will assume a lower level within flowing fluid 52, than smaller particles, such as particles 50, because the terminal velocity of large particles is generally higher than that of small particles. It is noted that the terminal velocity of a rigid sphere, as given by Stokes' Law, is proportional to the square of the radius of the sphere. If the flow velocity of fluid 52 is increased, by rate controller 26, all particles will move upward to new equilibrium positions. Returning to the operation of apparatus 10, as the flowing fluid 52 passes through the large diameter end 20 of the cone-shaped pipe 12, it is deflected horizontally by the deflection plate 42, as schematically indicated by a pair of deflection streamlines 54. Therefore, a quantity of particles 56, within fluid 52, vertically descends onto and is collected upon the shelf-like flange 40. The particles 56 are generally the smallest particles within flowing fluid 52, and they descend and are collected because following the horizontal deflection of fluid 52, there is no longer an upward velocity component of fluid flow to sustain their position against the force of gravity.

The volumetric flow rate controller 26, of the apparatus 10, permits the flow velocity of fluid 52 to be successively and sequentially increased, so that successive fractions of larger particles can be removed from pipe 12, and collected on shelf-like flange 40, as the particles in fluid 52 sequentially move upward to new equilibrium levels, as explained above.

As it has been described up to this point, a difficulty sometimes arises in apparatus 10 because particles tend to stick on the smooth internal walls 14 of hollow pipe 12, since the flow velocity of any viscous fluid is always identically equal to zero on the internal surfaces of any pipe through which the fluid is flowing. To remedy this potential difficulty, and if required, the cone-shaped hollow pipe 12 is perforated throughout with a multiplicity of holes 68 that are approximately 1 to 50 microns in diameter, and spaced apart from one another by a distance of approximately 5 to 200 microns. In this configuration, pipes such as pipe 12 have been fabricated from screening material that is approximately 2 mils thick. Apparatus 10 is then further comprised of an outer housing 58 that is attached to pipe 12 by a pair of supports 60. Housing 58 is spaced apart from pipe 12 to provide an enclosed space 62 between housing 58 and pipe 12. The housing 58 is shown as an outer cone-shaped shell that is symmetrically disposed about pipe 12, and this configuration is very convenient in many situations. By means of a pipe 64 and an enclosure 66, as shown, fluid may be intromitted into the enclosed space 62. This fluid and the fluid provided by the fluid source 22 are most often identical in type or variety. The pressure of the fluid in the enclosure 66 and the adjoining enclosed space 62 is adjusted, by any convenient and well known means, not shown, so that the fluid flows inwardly through the holes 68 into the interior of the cone-shaped pipe 12, to thereby prevent particles from sticking on the internal walls 14.

It is sometimes preferred to attach a group of one or more high frequency vibrators 70 to the apparatus 10 to prevent particles from agglomerating, or sticking, within apparatus 10. The vibrators 70 may be attached to apparatus 10 at any convenient locations, as desired. High frequency vibrators are well known. They are typically very simple electromechanical or air actuated devices, and they are commercially supplied by many manufacturers.

It is thus appreciated that in accordance with the invention as herein described and shown in the FIGURE, efficient, rapid and accurate methods and apparatus are provided for particle separation and classification.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. An apparatus for separating and classifying an ensemble of particles of diverse size and shape into a multiplicity of portions of particles of similar size and shape, the apparatus comprising:

a cone-shaped hollow pipe symmetric about an axis thereof, having a smooth internal wall that is perforated throughout with holes that are approximately 1 to 50 microns in diameter and spaced apart from one another by a distance of approximately 5 to 200 microns, said pipe having an end of small diameter and an end of large diameter;

means, adapted to function at a variable rate of volumetric flow, for introducing a steady laminar flow of a first quantity of a fluid into the small diameter end of the pipe;

means for inserting the ensemble of particles into the pipe so that the ensemble is dispersed within the fluid;

an axially-symmetric shelf-like flange attached to the large diameter end of the pipe and extending perpendicularly outward from the axis of the pipe;

an axially-symmetric deflection plate oriented perpendicularly to and across the axis of the pipe, and mounted in a spaced apart relationship to the large diameter end of the pipe;

an outer housing that is attached to the cone-shaped pipe but spaced apart from an external wall of the pipe, to provide an enclosed space between the outer housing and the external wall of the pipe; and means for intromitting a second quantity of the fluid into the enclosed space at a pressure that causes the fluid to flow inwardly through the holes in the pipe, and thereby prevent particles from sticking on the smooth internal wall of the cone-shaped pipe;

whereby, when the apparatus is in use the large diameter end of the pipe is upward and the axis of the pipe is oriented vertically, the fluid undergoes an upward steady laminar flow, within the pipe, that has an approximately common upward velocity at location shaving an approximately common vertical height; the upward velocity of the fluid monotonically decreases in magnitude at increasingly higher locations within the pipe; each portion of particles of similar size and shape migrates to an individual region within the fluid of approximately common vertical height whereat the terminal velocity of the particles of that portion, with respect to the fluid, is approximately equal to the upward velocity of the fluid; and, the fluid, as it passes through the large diameter end of the pipe, is deflected horizontally by the deflection plate, so that all the particles within the deflected fluid begin to undergo a vertical descent and are collected upon the shelf-like flange.

2. An apparatus for separating and classifying an ensemble of particles of diverse size and shape into a multiplicity of portions of particles of similar size and shape, as recited in claim 1, and further comprising a group of one or more high frequency vibrators attached to the apparatus to prevent particles from agglomerating within the apparatus.

3. An apparatus for separating and classifying an ensemble of particles of diverse size and shape into a multiplicity of portions of particles of similar size and shape, as recited in claim 1, wherein the means for introducing the steady laminar flow of the first quantity of the fluid into the small diameter end of the pipe comprises a sintered diffusing material through which the first quantity of the fluid is passed.

* * * * *